United States Patent [19]

Stollenwerk et al.

[11] 4,150,622

[45] Apr. 24, 1979

[54] PRINTING ROLLER

[76] Inventors: Joseph A. Stollenwerk, 2489 Waterford St., Oakville, Ontario; Reinhard Muhs, R.R. #5, Orangeville, Ontario, both of Canada

[21] Appl. No.: 818,496

[22] Filed: Jul. 25, 1977

Related U.S. Application Data

[63] Continuation-in-part of Ser. No. 722,799, Sep. 13, 1976, abandoned.

[51] Int. Cl.[2] ..... B41F 13/10; B41F 27/10

[52] U.S. Cl. ..... 101/378; 101/382 MV; 29/129; 29/113 R

[58] Field of Search ..... 101/375, 376, 382 MV, 101/378; 29/129, 117, 113 R, 129.5

[56] References Cited

U.S. PATENT DOCUMENTS

| | | | |
|---|---|---|---|
| 163,217 | 5/1875 | Lawson | 29/117 X |
| 1,958,299 | 5/1934 | Ericksson | 101/375 |
| 2,020,219 | 11/1935 | Sirianni | 29/117 |
| 2,181,798 | 11/1939 | Blackley | 29/129 X |
| 2,367,088 | 1/1945 | Benson | 29/117 |
| 2,604,128 | 7/1952 | Dick et al. | 29/129 |
| 2,638,282 | 5/1953 | Prevost | 29/117 |
| 2,674,012 | 4/1954 | Noelting | 29/129 X |
| 2,987,994 | 6/1961 | Allison | 101/375 |
| 3,640,218 | 2/1972 | Allison | 101/375 |
| 3,649,985 | 3/1972 | Hunt | 29/117 X |
| 3,739,722 | 6/1973 | Zottoli | 101/375 |

FOREIGN PATENT DOCUMENTS

| | | | |
|---|---|---|---|
| 929081 | 6/1963 | United Kingdom | 101/375 |

*Primary Examiner*—J. Reed Fisher

[57] ABSTRACT

A printing roller is disclosed comprising a mandrel fitted with a removable cylinder. The cylinder is retained on the mandrel by radially expansible, resilient rings which extend around the mandrel. In one embodiment, the mandrel includes a number of cylindrical sections between which the rings are disposed and means are provided for compressing the sections to cause radial expansion of the rings. In other embodiments, the roller mandrel has an internal air passageway which communicates with the grooves receiving the rings and provision is made for delivery of pressurized air to the air passageway so as to cause the rings to expand.

2 Claims, 10 Drawing Figures

PRINTING ROLLER

This application is a continuation-in-part of application Ser. No. 722,799 filed Sept. 13, 1976 now abandoned.

The present invention relates to printing rollers of the kind comprising a mandrel fitted with a removable cylinder.

In flexographic printing, rollers of this kind are used for supporting flexible printing plates made, for example, of rubber, neoprene or the like. The roller mandrel is designed to be rotatably mounted in a printing machine, and the printing plate is secured to the cylinder of the roller, normally by adhesive. The cylinder is removable from the mandrel to allow the printing plate to be changed without changing the entire roller.

An object of the present invention is to provide an improved printing roller of the kind described.

According to the invention, the roller comprises a mandrel which extends about a longitudinal axis and which is adapted to be mounted in a printing machine for rotation about said axis, and a hollow cylinder slidably mounted on the mandrel and having inner and outer surfaces concentric with said mandrel axis. The mandrel includes a support having a cylindrical outer surface concentric with said axis and a plurality of resilient rings extending around the outer surface of the mandrel support at positions spaced longitudinally thereof. The rings are radially expansible into frictional engagement with the inner surface of the cylinder so as to retain the cylinder against displacement with respect to said mandrel support and means are provided for effecting and maintaining such radial expansion of the rings when the printing roller is in use.

In order that the invention may be more clearly understood, reference will now be made to the accompanying drawings which illustrate a number of embodiments thereof, and in which.

Figure 1:
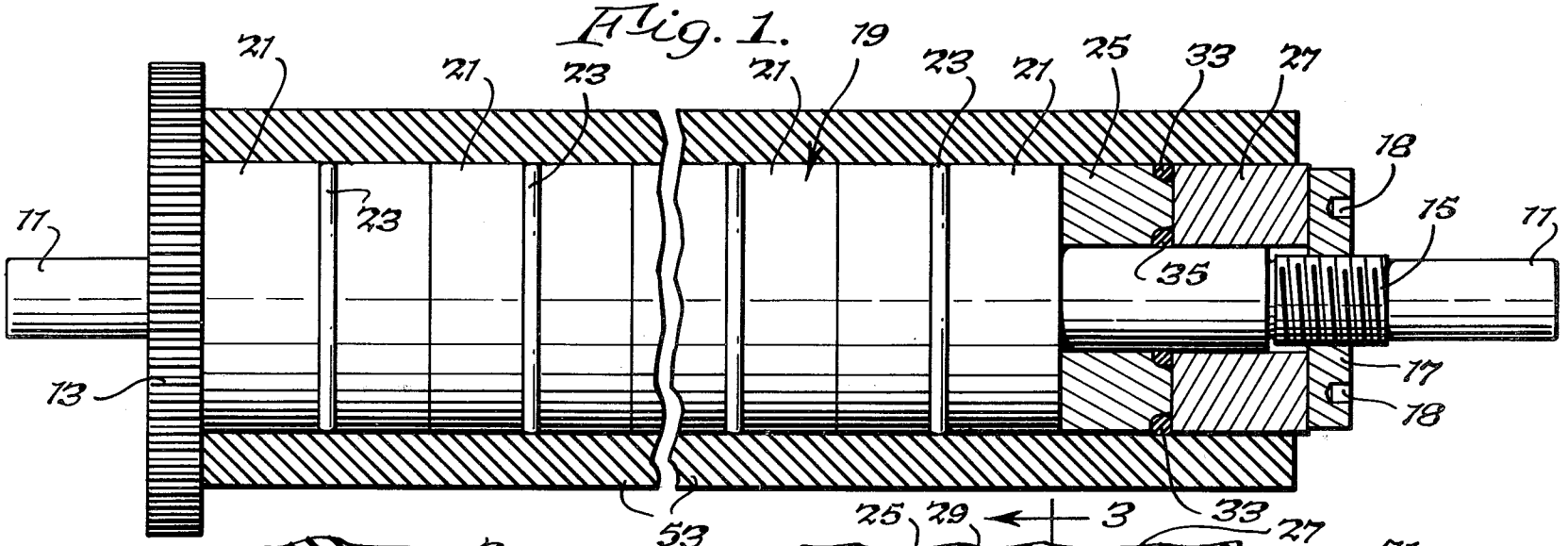
FIG. 1 is a longitudinal sectional view through a printing roller according to one embodiment of the invention.
Figure 2:
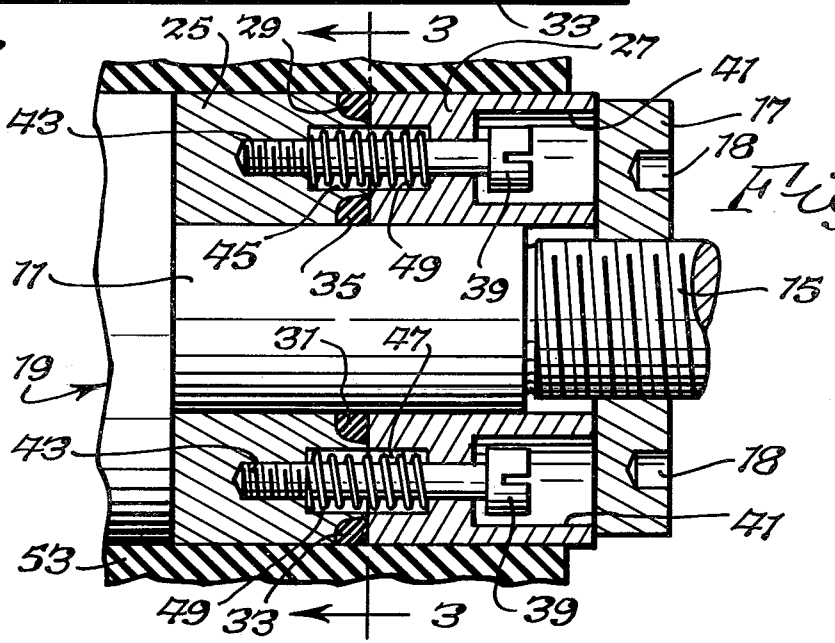
FIG. 2 is an enlarged fragmentary sectional view of part of the roller shown in FIG. 1.
Figure 3:
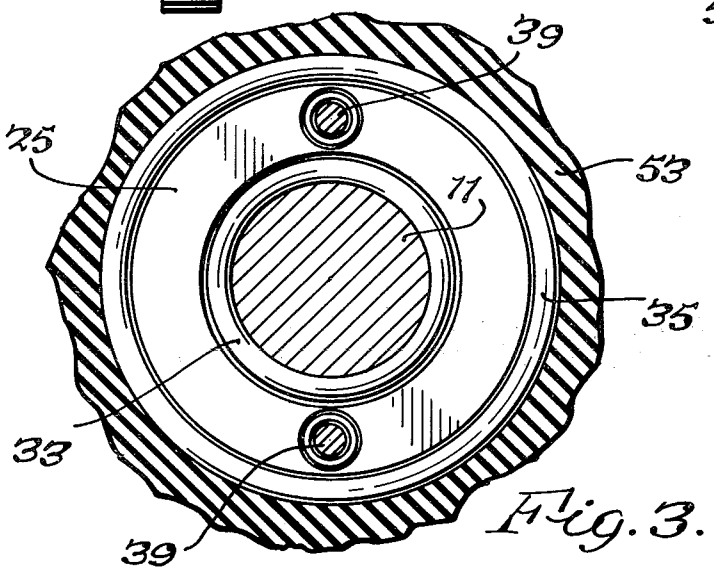
FIG. 3 is a transverse sectional view on line 3—3 of FIG. 2.

Reference will first be made to the embodiment illustrated in FIGS. 1 to 3, in which a printing roller is shown mounted on a shaft intended to be rotatably supported in a flexographic printing machine. The roller includes a mandrel generally denoted 19 and a hollow cylinder 53 slidably mounted on the mandrel. The cylinder has an outer cylindrical surface to which a flexible printing plate (not shown) is secured when the roller is in use. The shaft on which the roller is supported is generally designated 11 and is fitted with a spur gear 13 disposed adjacent one end of mandrel 19. In use, the roller is driven in rotation by way of gear 13. Adjacent the opposite end of the roller, shaft 11 includes a screw threaded portion 15 fitted with a nut 17 which bears against the adjacent end of the mandrel for the purpose to be described.

Mandrel 19 includes a support formed by a plurality of cylindrical sections 21 disposed end to end, and a plurality of flexible, resilient O-rings 23 which extend around the support at positions spaced longitudinally thereof. The sections are formed with aligned axial bores which receive shaft 11. The rings each have a normal outer diameter substantially equal to that of the sections 21, but are radially expansible into frictional engagement with the inner surface of cylinder 53 so as to retain the cylinder against axial and radial displacement as will be described. It will be noted that, in this embodiment, the mandrel includes eight of the cylindrical sections 21 and four resilient O-rings 23.

The mandrel support additionally includes two further cylindrical sections 25 and 27 which are disposed at the end of the support remote from spur gear 13 and which act as spacers. One end face of the innermost section 25 bears against the adjacent cylindrical section 21, while the opposite face of section 25 is formed with concentric annular recesses 29 and 31 provided respectively at the outer and inner periphery of the section. O-rings 33 and 35 are mounted in respective recesses 29 and 31. The inner face of the adjacent section 27 is plain and the O-rings 33 and 35 project slightly from section 25 so that, if section 27 is moved towards section 25, the O-rings 33 and 35 are compressed. This causes O-ring 33 to expand radially outwardly and frictionally engage the inner surface of cylinder 53, while ring 35 expands inwardly to frictionally engage the shaft 11 and prevent rotation of section 25 with respect to the shaft. The O-rings 23 are similarly disposed in annular recesses (not shown) in end faces of appropriate ones of the sections 21 so that those rings also radially expand outwardly when the assembly of sections 21 is axially compressed. Such axial compression is effected by turning the nut 18 on the screw threaded portion 15 of shaft 11 in a direction which causes the nut to bear against the endmost support section 27 and displace sections 25 and 21 leftwards as viewed in FIG. 1 against the spur gear 13. This causes the O-rings 23 associated with the sections 21 and O-ring 33 of section 25 to be compressed and thereby expand radially outwardly into frictional engagement with the inner surface of cylinder 53. At the same time, O-ring 35 is expanded radially inwardly to frictionally engage shaft 11 and thereby restrain section 25 and, with it, the cylinder 53 and sections 21, against rotation with respect to the shaft. Section 27 is coupled to section 25 and is therefore prevented from turning when nut 17 is turned as will be described with reference to FIGS. 2 and 3. In this connection, it is to be noted that the sectional views of FIGS. 1 and 2 are taken on respectively different planes.

Sections 25 and 27 are coupled together by two machine screws 39 disposed in aligned bores in the sections. The portions of the bores in section 25 are screw threaded as indicated at 43 in FIG. 2, while the outer portions of the bores in section 27 are counter-sunk as indicated at 41 to receive the screw heads. The portions of the bores which open into opposed faces of the two sections 25 and 27 are also counter-sunk as indicated at 45 and 47 and receive compression springs mounted on the screws 39. The springs tend to force the sections 25 and 27 apart, thereby restraining the screws against accidental loosening.

It will be appreciated that the described roller mandrel construction allows rapid and convenient adjustment and/or replacement of cylinder 53 by loosening the nut 17 on shaft 11 to remove the compressive force on the O-rings 23, 33 and 35 and allow the rings to contract. Cylinder 53 can then be adjusted with respect to the mandrel 19, or completely removed from the mandrel by sliding the cylinder in the longitudinal direction of a roller, after removal thereof from the printing machine. To secure a cylinder in place after adjustment or replacement, nut 17 is tightened to compress the sections which make up the mandrel 19 and compress the O-rings 23, 33 and 35 so that they radially engage the cylinder and shaft 11 as described. To facilitate turning of nut 17, recesses 18 are provided in its outer face for engagement by a wrench.

Figure 4:
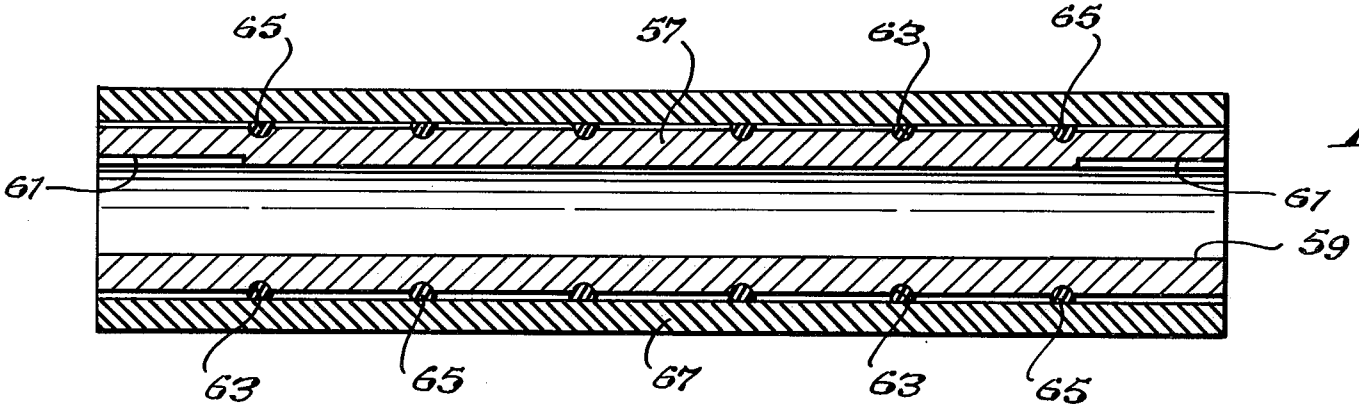
FIG. 4 is a longitudinal sectional view through a printing roller according to a second embodiment of the invention.
Figure 6:
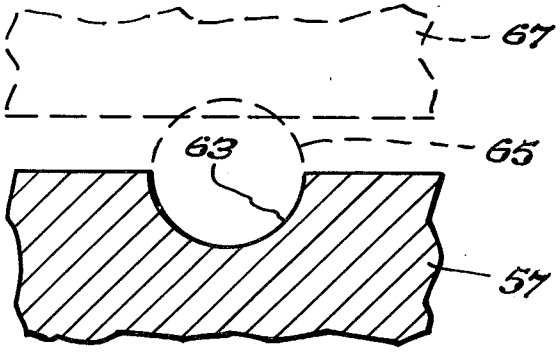
FIG. 6 is an enlarged fragmentary transverse sectional view of part of FIG. 4.
Figure 5:
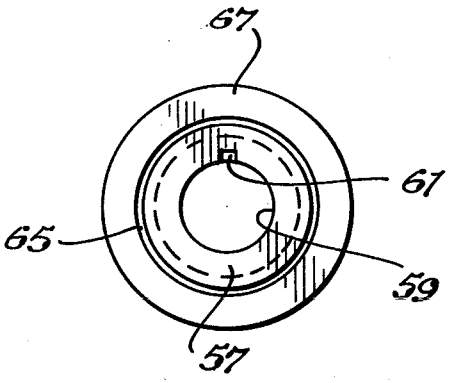
FIG. 5 is an end view of the roller shown in FIG. 4.

FIGS. 4 to 6 illustrate a further form of roller for supporting a flexographic printing plate. This embodiment is particularly useful in flexographic printing in which the printing cylinders are of small diameter and relatively short length. The roller includes a mandrel having an elongate cylindrical support 57. Support 57 is provided with a central bore 59 adapted to slidably receive a supporting shaft (not shown) to which it can be non-rotatably connected by suitable keys (not shown) engaging in longitudinal keyways 61 provided at the ends of the bore 59. At spaced intervals along its length, the mandrel support 57 is provided with parallel, annular, external grooves 63, each of which receives a flexible, elastic O-ring 65 of rubber or other suitable elastomer. The grooves 63 have a U-shaped cross section with the width thereof being greater than the depth thereof, and preferably about 1.2 times the depth. The O-rings are of a thickness approximately equal to the width of the grooves 63 and accordingly, will project radially outwardly therefrom.

The roller also includes a cylindrical plate-supporting cylinder 67 which is mounted on the mandrel by pushing the cylinder over the mandrel against the frictional effect of the O-rings 65. The O-rings are somewhat flattened by the plate-supporting cylinder 67 and hold the latter in place on the mandrel. If desired, a keyway (not shown) can be provided at one end of the mandrel 57 in the exterior periphery thereof which can be engaged by a suitable key (not shown) on the plate-supporting cylinder as a precaution against turning of the cylinder with respect to the mandrel. Generally, it is preferred to have the spacing between the annular grooves on the outer surface of the mandrel in the range from about 0.6 to about 1.1 relative to the diameter of the mandrel.

The plate-supporting cylinders, such as 53 and 67, employed in the rollers described, should be of rigid construction. Suitable materials therefore are light metals, such as aluminum and aluminum alloys, and phenolic plastics. Other rigid plastics can also be used. The flexographic printing plates may conveniently be secured to the plate-supporting cylinders by a suitable adhesive. Preferably, the cylindrical sections 21 forming the mandrel 19 and the cylinder which forms the mandrel 57 are formed of suitable metal and are rigid.

It will be understood that there may be modifications of and variations from the preceding embodiments. For example, the number of sections used in forming the mandrel 19 may be varied and the O-rings 35 may be omitted if appropriate. Also, O-rings 23 may be provided between all of the sections 21.

Figure 7:
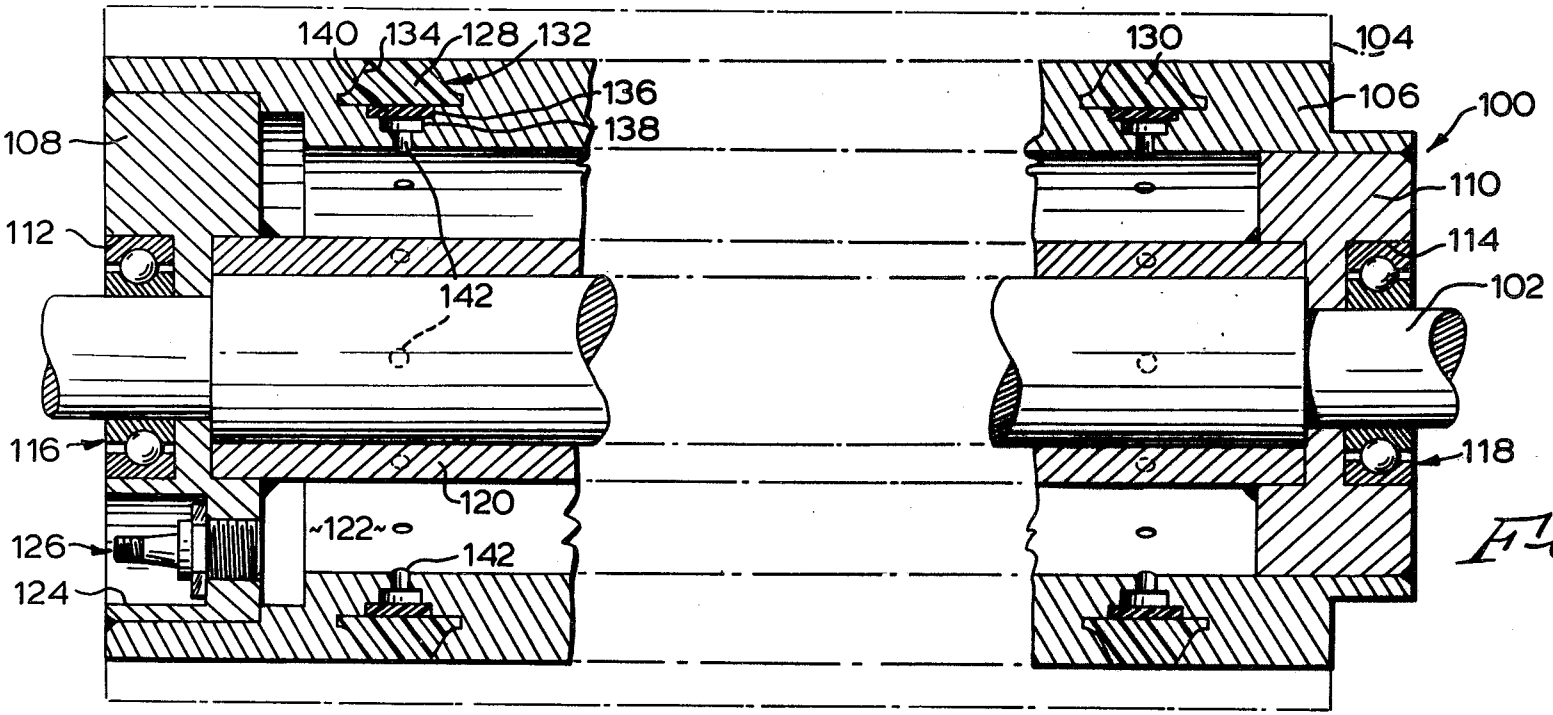
FIG. 7 is a longitudinal sectional view through a printing roller mandrel according to a further embodiment of the invention.
Figure 9:
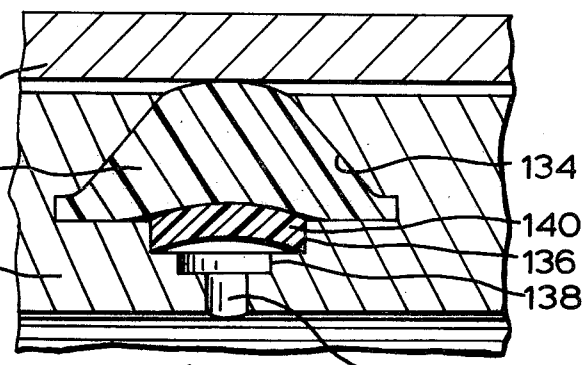
FIGS. 8 and 9 are fragmentary transverse sectional views of part of FIG. 7; and, FIG. 10 is a view similar to FIG. 7 of a still further embodiment of the invention.
Figure 8:
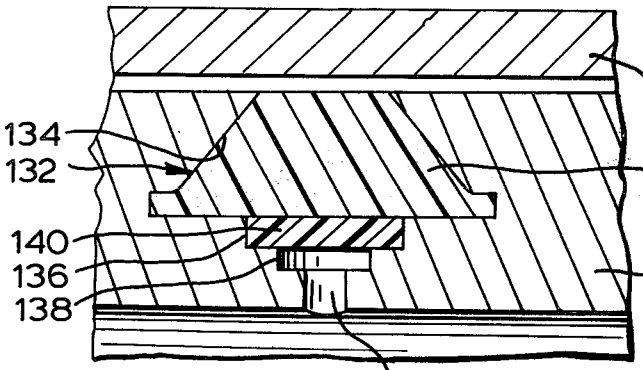

FIGS. 7 to 10 of the drawings illustrate printing rollers in which air pressure is employed to expand the mandrel rings into engagement with the cylinder of the roller. A first embodiment of a roller of this type is shown in FIGS. 7 to 9.

FIG. 7 shows a roller mandrel, generally designated 100, mounted on a shaft 102 to be rotatably supported in a printing machine. A cylinder to be retained on the mandrel is indicated in chain line at 104. Mandrel 100 includes a support formed by an outer cylindrical member 106 fitted with end plates 108 and 110 which are welded to member 106. The end plates are formed with respective recesses 112 and 114 which receive ball bearing assemblies 116 and 118 respectively for rotatably supporting shaft 102. An inner cylindrical member 120 extends between the end plates 108 and 110 around shaft 102 and defines with the outer cylindrical member 106 an air chamber 122. End plate 108 is formed with a recess 124 which is offset from the axis of shaft 102 and which receives an air valve 126 communicating with air chamber 122.

Mandrel 100 also includes a plurality of resilient rings which extend around the mandrel support at positions spaced longitudinally thereof. Two of these rings are indicated at 128 and 130 respectively in FIG. 7, although it is to be understood that any appropriate number of such rings may be provided depending, for example, on the intended use of the roller and on its length. In a typical case, four such rings would be used. In any event, each ring is received in an annular groove which encircles the outer cylindrical member 106 of the roller in a plane generally normal to its axis. Referring particularly to ring 128, the groove in which the ring is disposed is generally denoted 132 and includes an outer portion 134 of truncated generally triangular shape in cross section. The shape of the ring conforms with the shape of this portion of the groove. Disposed inwardly of portion 134 are two rectangular section portions 136 and 138. Portion 136 is somewhat wider than portion 138 and receives a band 140 which extends around the inner face of ring 128. The inner portion 138 of the groove communicates with the air chamber 122 inside the mandrel by way of four generally radial openings 142 in cylindrical member 106, although it is of course to be understood that the number of openings may vary depending on the particular roller.

Although only groove 132 for ring 128 has been described specifically, it is to be understood that the grooves for the other rings of the roller mandrel are of similar cross sectional shape. The grooves are formed by sequential machining operations performed on cylindrical member 106. After the grooves have been formed in the mandrel support, the elastic rings are cast in situ using a suitable polyurethane material. Referring specifically to ring 128, band 140 is placed in the rectangular portion 138 of groove 132 before the ring 128 is cast. Band 140 is itself made of a polyurethane material. Ring 128 is then cast in place by pouring liquid polyurethane material into the outer portion 134 of the groove while slowly rotating the roller. The material is overpoured to a slight extent with the result that the ring, when cured, protrudes slightly from the surface of cylindrical member 106. When the material is fully cured, the ring is ground to remove excess material and bring its outer surface flush with the outer surface of cylindrical member 106. The other rings are similarly cast in situ.

FIG. 8 is an enlarged view of part of the roller mandrel 100 including ring 128 and shows the cylinder 104 in position around the mandrel. To secure cylinder 104 to the mandrel (assuming the roller is stationary), air pressure is applied to air chamber 122 (FIG. 7) by way of valve 126. The air communicates by way of the openings 142 in cylindrical member 106 with groove 132 and acts on the inner surface of band 140, causing the ring 128 to expand radially outwardly as shown in FIG. 9 to frictionally engage and retain cylinder 104. The air pressure will be applied to chamber 128 using a conventional air hose. When the rings have been expanded to the required extent, the air hose will be removed and valve 126 will allow the pressure to be maintained in chamber 122 so that the cylinder 104 will be frictionally retained on the mandrel by way of the expanded rings. In this connection, it will be appreciated that the air pressure in chamber 122 will be substantially uniformly distributed around the inner surface of each ring as a by way of the inner rectangular portion 138 of groove 132. Accordingly, the ring will be automatically held in a position in which it is concentric with the longitudinal axis of shaft 102 (within manufacturing tolerances) so that the cylinder 104 will, in turn, be concentrically positioned about said axis. When the cylinder is to be removed or adjusted, air pressure in chamber 122 is released by opening valve 126 (e.g. by inserting a small screwdriver or the like into the valve) and the rings 128, 130 will return at least substantially to their original positions, freeing cylinder 104 for movement with respect to the mandrel.

Figure 10:
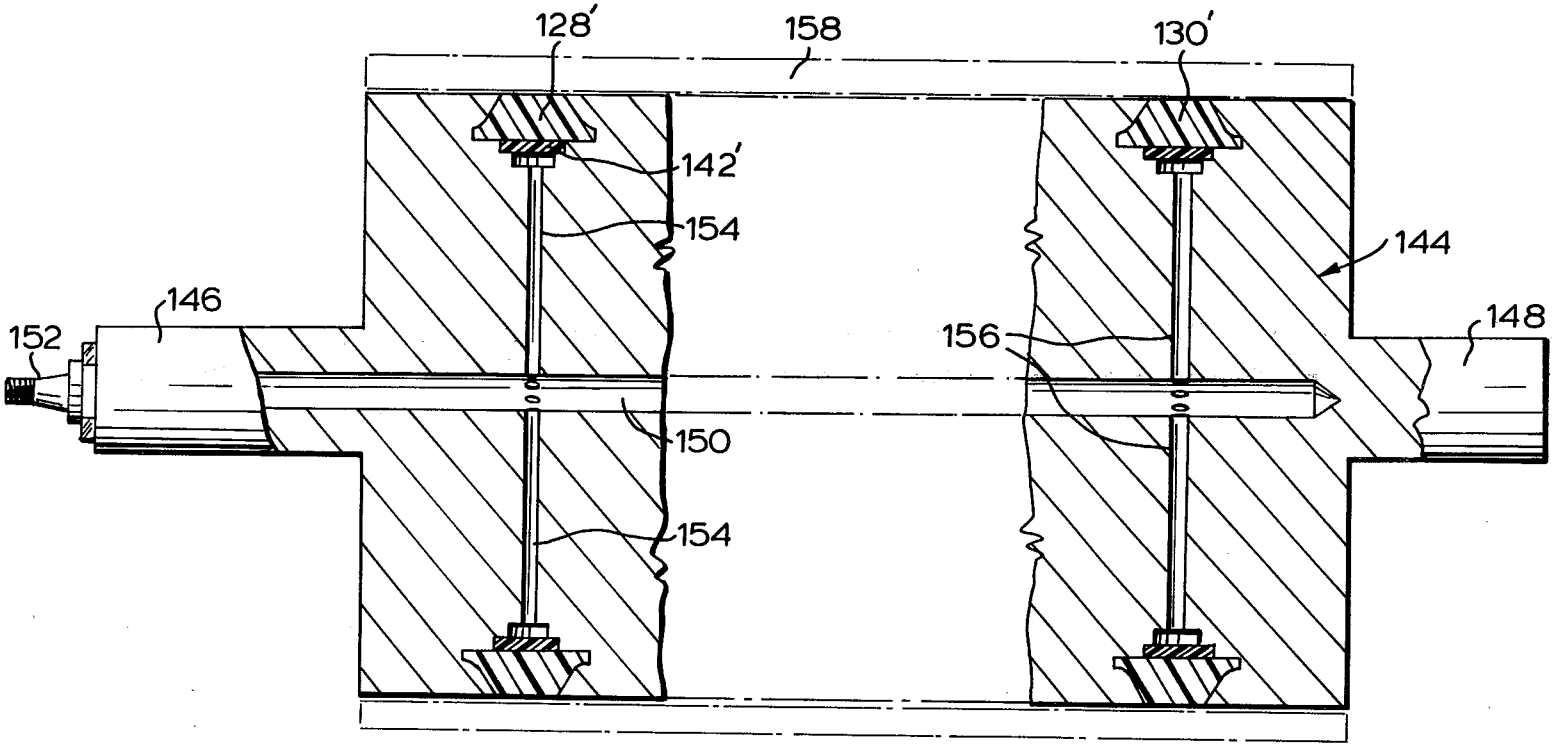

The roller shown in FIGS. 7 to 9 is of a type which is intended to be freely rotatable in use and in which the roller mandrel is hollow to receive a support shaft. FIG. 10 shows an alternative embodiment in which the roller mandrel is formed with integral journals intended to be rotatably supported in a printing machine. The roller mandrel support is generally indicated at 144 in FIG. 10 and includes integral journals 146 and 148 aligned on common longitudinal axis of the mandrel. The support 144 and journals 146 and 148 are machined from a solid cylindrical workpiece. A plurality of longitudinally spaced rings are provided at the outer periphery of support 144 and are of similar form to the rings described in connection with the preceding embodiment. Accordingly, primed reference numerals have been used to denote parts corresponding to parts of FIG. 7. In FIG. 10, the mandrel support is formed with an axially extending air passageway 150 which opens into the outer end of journal 146 and which terminates at its inner end in the region of the opposite end of the mandrel support 144. A valve 152 is fitted to journal 146 at the outer end of passageway 150. Radially extending passageways 154, 156 extend outwardly from the central air passageway 150 to the grooves in which the rings of the mandrel are received.

The roller shown in FIG. 10 is employed in essentially similar fashion to the roller of FIG. 7. In order to secure in place on the mandrel, a cylinder such as that indicated in ghost outline at 158, air pressure is applied to passageway 150 by way of valve 152. This air pressure communicates by way of radial passageways 154 and 156 with the peripheral grooves in which the rings 128', 130' are disposed, causing the rings to radially expand as described in connection with the preceding embodiment. If the air pressure is released by opening valve 152, the rings return generally to their original positions, freeing the cylinder 158 so that it can be removed from the mandrel.

It should be noted that the preceding description relates to specific embodiments of the invention and that many modifications are possible. For example, referring to the embodiments of FIGS. 7 to 10, it is not essential that the peripheral rings be of the specific form described. The rings could, for example, be in the form of separately manufactured elastic bands positioned in grooves in the mandrel support. Also, referring to the embodiment of FIG. 7, the form of roller disclosed therein is not essentially of the freely rotatable type. The mandrel could be fitted with a gear wheel such as that disclosed in connection with the embodiment of FIGS. 1 to 3, for use in driving the roller. Similarly, a gear wheel could, of course, be fitted to one of the journals 146, 148, or directly to the mandrel support 144 of the roller of FIG. 10.

What we claim is:

1. A printing roller comprising:

a mandrel extending about a longitudinal axis and adapted to be mounted in a printing machine for rotation about said axis;

a hollow cylinder slidably mounted on the mandrel and having inner and outer curved surfaces concentric with said mandrel axis;

the mandrel comprising a support having a continuous cylindrical outer surface concentric with said axis and formed with a plurality of peripheral grooves spaced longitudinally of the support, and a plurality of resilient rings disposed in each of said grooves, said rings being radially expansible into frictional engagement with said inner surface of the cylinder so as to retain the cylinder against axial displacement with respect to the mandrel, and said support being formed with at least one air passageway communicating with each of said grooves inwardly of the ring therein;

and one way air valve means accessible from externally of the roller and communicating with said air passageway so as to allow air to enter said passageway while preventing return flow of air therefrom, whereby the air in said passageway can be pressurized to cause outward radial expansion of said rings into frictional engagement with said cylinder;

and wherein each of said grooves in the support includes: an annular outer portion of generally truncated triangular shape receiving said ring; an intermediate annular portion disposed inwardly of said outer portion and receiving an annular band disposed inwardly of said ring; and an annular inner portion disposed inwardly of said band and communicating with said air passageway, whereby pressurized air in said passageway is distributed substantially uniformly in said inner portion of the groove and acts on said ring by way of said band, so as to expand the ring substantially concentrically with the axis of the roller in use.

2. A roller as claimed in claim 1, wherein said mandrel support is formed by a cylindrical body having co-axial journals projecting outwardly from opposite ends of said body, and wherein said air passageway includes a bore extending axially of said body and having an open end at an end of one of said journals, said open end being fitted with said valve means, and radial bores extending outwardly from said axial bore and communicating with said grooves.

* * * * *